US005079927A

United States Patent [19]

Rodino et al.

[11] Patent Number: 5,079,927

[45] Date of Patent: Jan. 14, 1992

[54] BEER COOLING APPARATUS

[76] Inventors: A. J. Rodino, 1325 Romain Ave.; James R. Kinkaide, 51154 Aqua Dr., both of Elkhart, Ind. 46514

[21] Appl. No.: 801,953

[22] Filed: Nov. 26, 1985

[51] Int. Cl.[5] ..... F25P 17/02

[52] U.S. Cl. ..... 62/99; 62/396; 62/389; 62/399

[58] Field of Search ..... 62/393, 394, 396, 98, 62/99, 399, 389, 400; 222/399, 464; 137/212

[56] References Cited

U.S. PATENT DOCUMENTS

| | | | |
|---|---|---|---|
| 1,289,364 | 12/1918 | Beggs . | |
| 2,141,221 | 12/1938 | Panagopoulos | 62/393 |
| 2,162,842 | 6/1939 | Dolison et al. | 62/393 X |
| 2,230,905 | 2/1941 | Popky | 62/393 X |
| 2,316,376 | 4/1943 | Weiss | 62/394 X |
| 2,325,228 | 7/1943 | Cornelius | 62/393 X |
| 2,446,895 | 8/1948 | Weiss | 62/394 X |
| 2,447,769 | 8/1948 | Pringey | 62/394 X |
| 2,638,758 | 5/1953 | Dawn | 62/394 |
| 2,646,667 | 7/1953 | Kromer | 62/394 X |
| 2,749,930 | 6/1956 | Whitnall | 137/212 |
| 2,774,229 | 12/1956 | Thau et al. | 62/393 X |
| 2,792,692 | 5/1957 | Bryan | 62/400 X |
| 3,137,326 | 6/1964 | Welty et al. | 141/18 |
| 3,195,788 | 7/1965 | Wilson | 222/399 |
| 3,307,751 | 1/1966 | Kraft | 222/464 |
| 3,447,558 | 6/1969 | Cserny | 137/212 |
| 3,608,778 | 9/1971 | Paranto | 222/30 |
| 4,031,913 | 6/1977 | Apellaniz | 137/170.1 |
| 4,437,319 | 3/1984 | Iannelli | 62/399 X |
| 4,462,220 | 7/1984 | Iannelli | 62/201 |

*Primary Examiner*—Albert J. Makay
*Attorney, Agent, or Firm*—Barnes & Thornburg

[57] ABSTRACT

A method and apparatus is provided for dispensing beer from a keg without excess foaming wherein the keg and beer temperatures and fluid pressures are controlled such that beer is dispensed at predetermined temperatures at substantially atmospheric pressures even over a wide range of atmospheric temperatures. Beer is supplied under pressure from the keg to a constricted flow line which abruptly decreases flow pressure. A portion of the constricted flow line is immersed in a refrigerating bath to reduce beer temperature. The length of the constricted flow line to the dispensing nozzle is sufficient long and its internal diameter sufficiently smooth that beer flow therethrough is stabilized to significantly reduce turbulence. Beer pressure drop through the nozzle is minimal and beer flow is relatively laminar.

The portion of the constricted line immersed in the refrigerating bath is formed from coiled tubing. The bath fluid is recirculated and the bath temperature is sufficiently low as to cause ice to form. The constricted line has a constant internal diameter throughout its length, and the dispensing nozzle has that same internal diameter. A portable embodiment includes a wheeled trailer for supporting and sheltering the keg.

10 Claims, 1 Drawing Sheet

BEER COOLING APPARATUS

BACKGROUND AND SUMMARY OF THE INVENTION

The present invention relates generally to beer dispensing apparatus. More particularly, this invention provides a means of dispensing beer from a keg without excess foaming of the beer.

It has been extremely difficult to prevent beer from foaming excessively when dispensed from a keg. As this foam cannot usually be condensed back into beer, there is often a significant amount of waste in drawing beer from a keg. This problem is even more pronounced when dispensing beer from a portable or unrefrigerated keg.

The present inventors have recognized that excess foaming is dependent upon both the temperature and pressure of the dispensed beer. Refrigeration of the keg will cool the beer inside and reduce foaming when dispensed. On the other hand if beer is dispensed while at room temperature or above, the beer can "go wild" and be dispensed as an entire keg of foam. Likewise, applying some pressure to the beer inside the keg will often decrease foaming when the beer is dispensed. However, too much pressure can also cause the beer to go wild. Further, in applying pressure it must be remembered that as the beer is dispensed, pressure is decreasing. At a constant temperature, the beer pressure can vary somewhat without excess foaming. However, the beer temperature itself is also typically changing during dispensing, particularly where the dispensing tubing is rather long.

Many prior attempts have been made to prevent or eliminate excess beer foaming. Unfortunately, none of these has been shown to be commercially successful, particularly with regard to portable and unrefrigerated dispensing arrangements. Stationary arrangements found in bars and restaurants typically store the beer kegs in a refrigerated room or cabinet. Such refrigeration is relatively inefficient since much more than the beer itself must be cooled. Also, tubing is usually run from the keg to the tap to transport the beer for dispensing. In some instances this tubing must run over 100 feet. As a result, the beer is significantly warmer than when inside the keg and line losses have greatly decreased the fluid pressure. Thus, not only is the draw poor, it can be all foam.

To correct this problem, tubing has been insulated and/or immersed in ice baths on the way to the tap and fluid pressure at the keg has been increased. Unfortunately, these are incomplete and expensive remedies. Line losses and flow turbulence through the tubing can still create excess foaming. Cold plates have been suggested, but these typically require line pressure of 25–30 psi at the plate and are only suitable for short periods of use.

Refrigeration for a portable keg dispensing apparatus is typically impractical. Often, the keg is merely immersed in ice when dispensing outdoors in the summer. Unfortunately, ice melts away and must be replenished in a short time and does not maintain the beer at a constant and sufficiently low temperature. With temperature variation, pressure variations are more susceptible of causing excess foaming. Further, it is disadvantageous for the portable dispensing apparatus to be encumbered with the long tubing lines necessary to cool beer from unrefrigerated kegs by immersion in ice baths.

It is, therefore, an object of the present invention to provide an improved system for dispensing beer.

Another object is the provision of a method and apparatus for dispensing beer from a keg without excess foaming.

A further object is to provide a means of dispensing beer at predetermined reduced temperatures and atmospheric pressure over a wide range of atmospheric temperatures in the dispensing environment.

Still another object is the provision of an efficient, inexpensive portable apparatus for dispensing beer from a keg.

Yet another object is to provide a lightweight, compact, portable keg dispenser for beer which is effective year round and operable on standard, household electrical power supplies.

These and other objects of the present invention are attained in the provision of a method and apparatus for dispensing beer from a keg without excess foaming wherein the keg and beer temperatures and fluid pressures are controlled such that beer is dispensed at predetermined temperatures at substantially atmospheric pressures even over a wide range of atmospheric temperatures. Beer is supplied under pressure from the keg to a constricted flow line which abruptly decreases flow pressure. A portion of the constricted flow line is immersed in a refrigerating bath to reduce beer temperature. The length of the constricted flow line to the dispensing nozzle is sufficiently long and its internal diameter sufficiently smooth that beer flow therethrough is stabilized to significantly reduce turbulence. Beer pressure drop through the nozzle is minimal and beer flow is relatively laminar.

The portion of the constricted line immersed in the refrigerating bath is formed from coiled tubing. The bath fluid is recirculated and the bath temperature is sufficiently low as to cause ice to form. The constricted line has a constant internal diameter throughout its length, and the dispensing nozzle has that same internal diameter. A portable embodiment includes a wheeled trailer for supporting and sheltering the keg.

Other objects, advantages and novel features of the present invention will become readily apparent upon consideration of the following detailed description in conjunction with the drawings.

DESCRIPTION OF THE PREFERRED EMBODIMENTS

Figure 1:
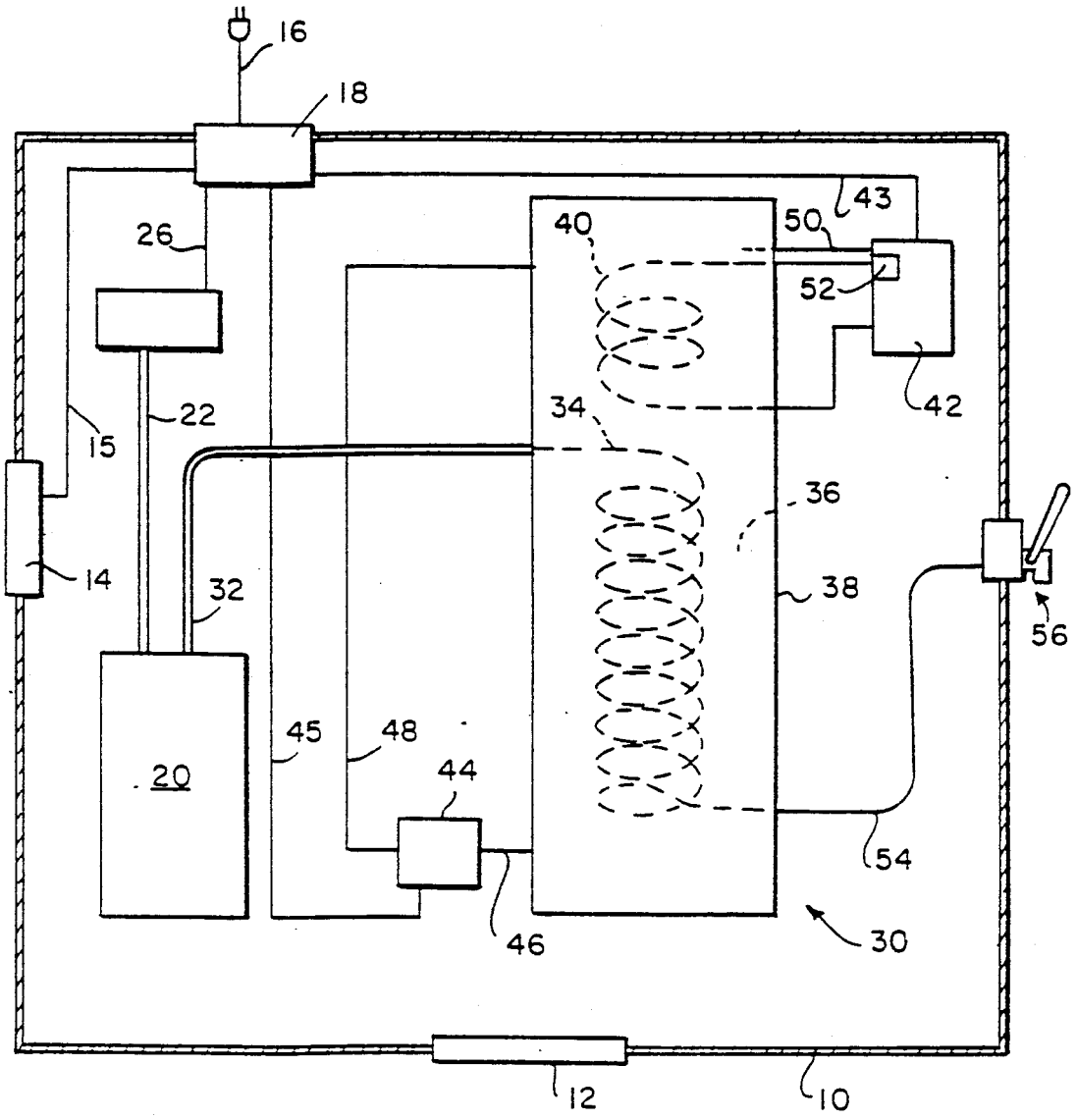
FIG. 1 is a schematic diagram of the present invention as applied to a portable embodiment.

FIG. 1, which illustrates schematically a preferred embodiment of the present invention, shows a portable structure 10 having keg 20 and beer dispensing apparatus 30 therein. The present invention controls temperature and pressure to cool beer and dispense it without excess foam. This invention permits efficient beer dispensers to be readily portable.

Structure 10 is, for example, an enclosed trailer unit mounted on wheels (not shown) such that it can be readily towed by an automobile. One or more kegs 20 containing beer and a plurality of dispensing apparatus 30 can be supported and stored within structure 10. That structure also provides shelter for keg 20 from direct sunlight and heat. Structure 10 is, for example, totally enclosed and insulated, and its interior is accessible only through a door 12. Fan 14 is provided to cool the interior of structure 10. Structure 10 preferably maintains keg 20 at less than 80° Fahrenheit even if the outside temperature is much higher. Electric power is provided from line 16 to junction 18. Line 16 is, for example, an extension cord which can be plugged into any standard household outlet. Line 15 from junction 18 provides electricity to drive fan 14.

Keg 20 contains a volume of beer therein and is supplied with compressed air along line 22 from air compressor 24. Although illustrated within structure 10, it will now be readily understood that compressor 24 can be mounted in whole or part on the exterior of structure 10, with line 22 passing therein to keg 20. Electric power from junction 18 is provided by line 26 to drive compressor 24. Likewise, it will now be readily understood that any or all of the electrically driven devices of this invention can be connected separately to a power source, rather than through junction 18.

Line 32 is connected to keg 20 to transport beer therefrom. Line 32 is, for example, a polyvinyl conduit or tubing, preferably having a constant $\frac{5}{8}$ inch interior diameter with no constrictions therein. Suitable tubing is presently commercially available from Tap-Rite Company of Hackensack, New Jersey under the trade mark Tap-Roid MQ Vinyl Beverage Tubing.

When compressed air from line 22 is applied to keg 20, beer is forced through line 32. This compressed air is preferably in the range of 10–35 psi, with 30 psi often found to be optimum. Air pressure is regulated by compressor 24 to be substantially constant during the entire dispensing operation. By using such low air pressures, compressor 24 can be of a commercially available type that runs on standard household electrical current and voltage. Thus, a portable dispensing apparatus according to the present invention can be installed virtually anywhere.

Line 32 is connected to constricted line 34. This constricted line is preferably immersed within cooling bath 36 contained in precooler 38. Line 34 is, for example, coiled copper tubing having a constant $\frac{1}{4}$ inch interior diameter. Thus, the connection of line 32 to line 34 functions as a choke to the flow of beer from keg 20 to significantly lower the flow pressure.

Coiled line 34 further serves as a single pass heat exchanger to cool the beer flowing through it. Precooler 38 includes refrigeration coil 40, also immersed in bath 36. R-12 freon coolant, for example, flows through coil 40 from refrigeration compressor/control unit 42. The fluid of bath 36 is circulated past refrigeration coil 40 and through precooler 38 to coiled line 34 by pump 44, connected to precooler 38 by bath lines 46 and 48. Pump 44 and control unit 42 ensure that the temperature of bath 36 will be maintained at a constant, predetermined temperature even for long periods of time and large volumes of beer flowing therethrough. To this end, control unit 42 includes, for example, a bath temperature monitoring device 50 and an expansion valve 52 to regulate coolant flow through refrigeration coil 40.

It has been found to be advantageous to maintain bath 36 at a constant 32° Fahrenheit when dispensing beer. When this condition is achieved, ice has been found to condense about refrigeration coil 40 to a thickness of about $\frac{1}{4}$ inch. It is believed that the formation of such ice assists in maintaining constant temperature of bath 36. Pump 44 and control unit 42 are, for example, supplied with electricity from junction 18 by lines 45 and 43, respectively. Also, as will now be readily understood, a portion of pump 44 and control unit 42 may be mounted on the exterior of structure 10 (the coolant evaporator, for example). It should be noted that although refrigeration coil 40 is only shown in the drawing as at one end of precooler 38, in other embodiments it can extend for longer lengths. Also, while line 34 is illustrated as coiled and this configuration has been found to provide faster cooling of the beer, probably because of centrifugal forces, other line configurations are contemplated by the present invention in particular embodiments.

Coiled line 34 also serves to stabilize the beer flow therethrough and maintain the carbon dioxide gas of the beer in solution without foaming. This stabilization is believed to occur after the pressure drop from line 32 and in such a manner that turbulence within the beer flow is reduced. Cooling the beer and stabilizing the flow of beer in line 34 has been found to control bubble size and prevent foaming in the beer.

Line 54 connects to line 34 at the sidewall of precooler 38. Line 54 is, for example, formed of the same material as line 32, except that it has a constant $\frac{1}{4}$ inch interior diameter throughout its length. Thus, the connection of line 34 and line 54 does not create an abrupt pressure change as where line 32 connects with line 34. Line 54 continues the beer flow stabilization function of coil 34. The combined lengths of these conduits is sufficient to induce laminar flow. In addition, line losses of beer flow through these lines gradually reduces flow pressure.

Line 54 connects to dispensing tap 56. The internal diameter of tap 56 is the same as the internal diameter of line 54. As a result of the cooling and stabilizing of lines 34 and 54 downstream from the choke point connection with line 32, beer is dispensed from tap 54 with a good draw and minimal foam. It has been found to be especially advantageous to adjust the pressure and temperature controls of the present invention such that beer pressure at tap 56 is the same as the atmospheric pressure and that beer temperature is 34° Fahrenheit. This can be done even over a wide range of atmospheric temperatures. Thus, the present invention can uniformly control and prevent foaming year round, even when dispensing outdoors from a portable unit.

Since the present invention provides cooling and stabilization after the choke point, and the choke point can be established in the proximity of the keg since keg refrigeration is unnecessary, long flow lines and expensive insulation are unnecessary. Good draw is achieved with the present invention even though the beer pressure through the bath is much less than 25–30 psi. With laminar flow of low temperature beer and no abrupt pressure changes, beer passing through the tap does not expand suddenly into foam. Stabilization and cooling are initiated simultaneously and relatively remote from the tap, thus less overall flow line length is required. Further, while illustrated as mounted within a portable structure, the present invention is readily applied to indoor applications as well.

Although the present invention has been described in detail, the same is by way of illustration and example only and is not to be taken by way of limitation. The spirit and scope of the present invention are to be limited only by the terms of the appended claims.

What is claimed is:

1. A beer cooling and dispensing apparatus comprising:

a keg container for beer having a pressure inlet and a fluid outlet;

a source of compressed air at a predetermined pressure connected to said pressure inlet;

a first supply line connected to said fluid outlet;

a second supply line connected to said first supply line;

a dispensing nozzle means connected to said second supply line;

a refrigerating means for cooling beer;

said first supply line having a larger interior diameter than said second supply line at the connection of said first and second supply lines and said second supply line including a coiled portion thereof immersed in said refrigerating means immediately adjacent said connection of said first and second supply lines such that the pressure and temperature of the beer flowing into said second supply line from said first supply line are substantially simultaneously decreased to cause the gaseous components of said beer to remain in solution;

said second supply line including a portion thereof for stabilizing turbulence of fluid beer passing therethrough and creating substantially laminer flow to said dispensing nozzle.

2. The apparatus according to claim 1 wherein said portion of said second supply line for stabilizing turbulence maintains a constant interior diameter over its entire length.

3. The apparatus according to claim 2 wherein said stabilizing portion of the second supply line is constructed of a polyvinyl material having decreased resistance to fluid flow therethrough.

4. The apparatus according to claim 2 wherein said connection of said first and second supply lines occurs at the initial immersion of said coiled portion in said refrigeration means.

5. The apparatus according to claim 1 wherein said refrigerating means includes a recirculating fluid bath maintained at a sufficiently low temperature that a limited amount of ice forms within said bath.

6. The apparatus according to claim 5 wherein said coiled portion of the second supply line is constructed of copper tubing.

7. The apparatus according to claim 6 wherein the interior diameter of said first supply line is $\frac{3}{8}$ inch, the interior diameter of said second supply line is $\frac{1}{4}$ inch and said predetermined pressure is between 10 and 35 psi.

8. An apparatus for preventing excessive foam in dispensing beer, comprising:

a source of beer pressurized to supply fluid from a first conduit;

means connected to said first conduit for receiving fluid from said first conduit and simultaneously decreasing both the pressure and the temperature of that fluid such that the gaseous components of said fluid remain in solution with the liquid beer;

dispensing means connected to and remote from said means for receiving fluid from said first conduit for dispensing beer substantially at atmospheric pressure and at reduced temperatures;

said means for receiving fluid including means for choking fluid flow to decrease fluid pressure and thereafter produce laminar fluid flow into said dispensing means; and said means for receiving fluid also including a second conduit means for transmitting said fluid to said dispensing means, said second conduit means including a coiled portion immersed in a refrigeration means for cooling said beer.

9. A method of dispensing beer from a keg with minimal foaming, comprising:

providing a flow of beer under a first pressure level from said keg;

decreasing the pressure of said flow of beer to a second pressure level and subsequently reducing the temperature of said beer at that second pressure level;

stabilizing the flow of beer at said second pressure level to reduce turbulence in said flow; and adjusting said pressure levels and the temperature of said beer such that said beer is dispensed at predetermined temperatures and substantially atmospheric pressures over a wide range of atmospheric temperatures in the dispensing environment.

10. The method according to claim 9 wherein the pressure of said flow of beer is reduced from second pressure level to substantially atmospheric pressure by line losses.

* * * * *

UNITED STATES PATENT AND TRADEMARK OFFICE

CERTIFICATE OF CORRECTION

PATENT NO. : 5,079,927

DATED : January 14, 1992

INVENTOR(S) : A. J. Rodino and James R. Kinkaide

It is certified that error appears in the above-identified patent and that said Letters Patent is hereby corrected as shown below:

In the Description of the Preferred Embodiments, column 3, line 23, please delete "5/8" and insert -- 3/8 -- therefor.

Signed and Sealed this

Sixth Day of April, 1993

*Attest:*

*Attesting Officer*

STEPHEN G. KUNIN

*Acting Commissioner of Patents and Trademarks*